US010464076B2

(12) United States Patent
Kruse

(10) Patent No.: US 10,464,076 B2
(45) Date of Patent: Nov. 5, 2019

(54) AIR CAP AND NOZZLE ASSEMBLY FOR A SPRAY GUN, AND SPRAY GUN

(71) Applicant: SATA GmbH & Co. KG, Kornwestheim (DE)

(72) Inventor: Albrecht Kruse, Stuttgart (DE)

(73) Assignee: SATA GMBH & CO. KG, Kornwestheim (DE)

( * ) Notice: Subject to any disclaimer, the term of this patent is extended or adjusted under 35 U.S.C. 154(b) by 311 days.

(21) Appl. No.: 15/379,972

(22) Filed: Dec. 15, 2016

(65) Prior Publication Data

US 2017/0173600 A1 Jun. 22, 2017

(30) Foreign Application Priority Data

Dec. 21, 2015 (DE) ..... 10 2015 016 474

(51) Int. Cl.
*B05B 1/02* (2006.01)
*B05B 1/14* (2006.01)
(Continued)

(52) U.S. Cl.
CPC ..... *B05B 1/02* (2013.01); *B05B 1/14* (2013.01); *B05B 7/02* (2013.01); *B05B 7/0815* (2013.01)

(58) Field of Classification Search
CPC .... B05B 1/02; B05B 1/14; B05B 7/02; B05B 7/0807; B05B 7/0815; B05B 7/0823; B05B 7/083; B05B 7/0838; B05B 7/0861
(Continued)

(56) References Cited

U.S. PATENT DOCUMENTS 40,433 A 10/1863 Sees
327,260 A 9/1885 Hart
(Continued)

FOREIGN PATENT DOCUMENTS

AT 153883 6/1997
AT 163577 3/1998
(Continued)

OTHER PUBLICATIONS

International Search Report dated Jul. 14, 2016 for International Application No. PCT/EP2016/000809, filed May 17, 2016.
(Continued)

*Primary Examiner* — Darren W Gorman
(74) *Attorney, Agent, or Firm* — Paul D. Bianco; Katharine Davis Wong; Fleit Gibbons Gutman Bongini & Bianco PL

(57) ABSTRACT

An air cap for a spray gun, in particular a paint spray gun, having at least one central opening, which is delimited by a mouth, and two horns, each having at least one inner and one outer horn air duct and one inner and one outer horn air opening. The spacing between the front end of the central opening and an axis which perpendicularly intersects the central axis of the central opening and runs through the center of an inner horn air opening is between 0.6 mm and 2.6 mm. The spray pattern generated by the air cap has a longer core region and a steeper transition of the layer thickness between the external region and the core region, compared to conventional air caps leading to improvement in coating quality. A nozzle assembly and a spray gun, in particular a paint spray gun, can have an air cap having the above properties.

30 Claims, 2 Drawing Sheets

(51) Int. Cl.
*B05B 7/02* (2006.01)
*B05B 7/08* (2006.01)

(58) Field of Classification Search
USPC ..... 239/290, 296–301
See application file for complete search history.

(56) References Cited

U.S. PATENT DOCUMENTS 459,432 A 9/1891 Anderson
459,433 A 9/1891 Avery
548,816 A 10/1895 Paul
552,213 A 12/1895 Troy
552,715 A 1/1896 Lugrin
563,505 A 7/1896 McCornack
581,107 A 4/1897 Emery
644,803 A 3/1900 Justi
672,012 A 4/1901 Ruper
574,880 A 5/1901 Schmidt et al.
1,662,496 A 3/1928 Forsgard
1,703,383 A 2/1929 Birkenmaier
1,703,384 A 2/1929 Birkenmaier
1,711,221 A 4/1929 Blakeslee
1,751,787 A 3/1930 Binks
1,889,201 A 11/1932 Holveck
2,004,303 A 6/1935 Wahlin
2,008,381 A 7/1935 Beeg
2,049,700 A 8/1936 Gustafsson
2,051,210 A 8/1936 Gustafsson
2,070,696 A 2/1937 Tracy
2,116,036 A 5/1938 Money
2,125,445 A 8/1938 Holveck
2,198,441 A 4/1940 Mollart
2,204,599 A 6/1940 Jenkins
2,269,057 A 1/1942 Jenkins
D133,223 S 7/1942 Tammen
2,356,865 A 8/1944 Mason
2,416,856 A 3/1947 Thomsen
2,416,923 A 3/1947 Jenkins
2,557,593 A 6/1951 Bjorkman
2,557,606 A 6/1951 Liedberg
2,559,091 A 7/1951 Reasenberg
2,609,961 A 9/1952 Sapien
2,612,899 A 10/1952 Webb
2,646,314 A 7/1953 Peeps
2,721,004 A 10/1955 Schultz
2,743,963 A 5/1956 Peeps
2,844,267 A 7/1958 Petriccione
2,886,252 A 5/1959 Ehrensperger
3,090,530 A 5/1963 Peeps
D196,477 S 10/1963 Kelly
3,159,472 A 12/1964 Revell
D200,594 S 3/1965 Sass
3,240,398 A 3/1966 Dalton, Jr.
D204,306 S 4/1966 Hamm
D205,760 S 9/1966 Hocutt et al.
D208,903 S 10/1967 Zadron et al.
3,344,992 A 10/1967 Norris
3,381,845 A 5/1968 MacDonald
3,417,650 A 12/1968 Varrin
3,420,106 A 1/1969 Keller et al.
3,435,683 A 4/1969 Keller et al.
3,482,781 A 12/1969 Sharpe
D217,928 S 6/1970 Felske
3,524,589 A 8/1970 Pelton, Jr.
3,527,372 A 9/1970 Manning
3,583,632 A 6/1971 Schaffer
3,622,078 A 11/1971 Gronert
3,645,562 A 2/1972 Fandetti et al.
3,656,493 A 4/1972 Black et al.
3,714,967 A 2/1973 Zupan et al.
3,746,253 A 7/1973 Walberg
3,747,850 A 7/1973 Hastings et al.
3,771,539 A 11/1973 De Santis
3,840,143 A 10/1974 Davis et al.
3,848,807 A 11/1974 Partida
3,857,511 A 12/1974 Govindan
3,870,223 A 3/1975 Wyant
3,873,023 A 3/1975 Moss et al.
3,938,739 A * 2/1976 Bertilsson ..... B05B 5/03 239/705
4,000,915 A 1/1977 Strom
D245,048 S 7/1977 Pool
D252,097 S 6/1979 Probst et al.
4,160,525 A 7/1979 Wagner
4,171,091 A 10/1979 van Hardeveld et al.
4,210,263 A 7/1980 Bos
4,273,293 A 6/1981 Hastings
4,278,276 A 7/1981 Ekman
4,411,387 A 10/1983 Stern et al.
4,478,370 A 10/1984 Hastings
D276,472 S 11/1984 Harrison
D278,543 S 4/1985 Gintz
4,545,536 A 10/1985 Avidon
4,562,965 A 1/1986 Ihmels et al.
4,580,035 A 4/1986 Luscher
4,585,168 A 4/1986 Even et al.
4,614,300 A 9/1986 Falcoff
4,643,330 A 2/1987 Kennedy
4,653,661 A 3/1987 Buchner et al.
4,667,878 A 5/1987 Behr
4,713,257 A 12/1987 Luttermoeller
D293,950 S 1/1988 Ogden et al.
4,730,753 A 3/1988 Grime
4,767,057 A 8/1988 Degli et al.
D298,372 S 11/1988 Taylor, Jr.
4,784,184 A 11/1988 Gates
4,806,736 A 2/1989 Schirico
4,826,539 A 5/1989 Harpold
4,832,232 A 5/1989 Broccoli
4,863,781 A 9/1989 Kronzer
4,877,144 A 10/1989 Thanisch
D305,057 S 12/1989 Morgan
4,887,747 A 12/1989 Ostrowsky et al.
4,901,761 A 2/1990 Taylor
4,906,151 A 3/1990 Kubis
4,917,300 A 4/1990 Gloviak et al.
4,946,075 A 8/1990 Lundback
4,964,361 A 10/1990 Aebersold
4,967,600 A 11/1990 Keller
4,969,603 A 11/1990 Norman
4,973,184 A 11/1990 La Salle
D314,421 S 2/1991 Tajima et al.
D314,588 S 2/1991 Denham
4,989,787 A 2/1991 Nikkel et al.
5,020,700 A 6/1991 Krzywdziak et al.
D318,877 S 8/1991 Miranda et al.
5,042,840 A 8/1991 Rieple et al.
D321,597 S 11/1991 Cerny
5,064,119 A 11/1991 Mellette
5,071,074 A 12/1991 Lind
5,074,334 A 12/1991 Onodera
5,078,323 A 1/1992 Frank
5,080,285 A 1/1992 Toth
5,088,648 A 2/1992 Schmon
5,090,623 A 2/1992 Burns et al.
5,102,045 A 4/1992 Diana
5,119,992 A 6/1992 Grime
5,125,391 A 6/1992 Srivastava et al.
5,135,124 A 8/1992 Wobser
5,143,102 A 9/1992 Blaul
5,165,605 A 11/1992 Morita et al.
5,170,941 A 12/1992 Morita et al.
5,190,219 A 3/1993 Copp, Jr.
5,191,797 A 3/1993 Smith
5,228,488 A 7/1993 Fletcher
5,232,299 A 8/1993 Hiss
5,236,128 A 8/1993 Morita et al.
5,249,746 A 10/1993 Kaneko et al.
D341,186 S 11/1993 Albers
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.

(56) References Cited

U.S. PATENT DOCUMENTS 5,333,908 A 8/1994 Dorney et al.
5,344,078 A 9/1994 Fritz et al.
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.
D365,952 S 1/1996 Gagnon et al.
5,503,439 A 4/1996 LaJeunesse et al.
5,529,245 A 6/1996 Brown
5,533,674 A 7/1996 Feyrer et al.
5,540,385 A 7/1996 Garlick
5,540,386 A 7/1996 Roman
D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
5,725,161 A 3/1998 Hartle
RE35,769 E 4/1998 Grime et al.
5,755,363 A 5/1998 Gantner et al.
5,762,228 A 6/1998 Morgan et al.
5,803,360 A 9/1998 Spitznagel
5,816,501 A 10/1998 LoPresti et al.
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,230,986 B1 * 5/2001 Vacher ..... B05B 7/0815 239/297
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski et al.
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 3/2003 Navis et al.
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 7/2004 Hurlbut et al.
6,766,763 B2 7/2004 Crum et al.
6,786,345 B2 9/2004 Richards
6,796,514 B1 9/2004 Schwartz
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann et al.
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,032,839 B2 4/2006 Biette
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic et al.
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin

(56) References Cited

U.S. PATENT DOCUMENTS

| | | | |
|---|---|---|---|
| 7,384,004 | B2 | 6/2008 | Rogers |
| RE40,433 | E | 7/2008 | Schmon |
| D573,227 | S | 7/2008 | Mirazita et al. |
| D574,926 | S | 8/2008 | Huang |
| D575,374 | S | 8/2008 | Huang |
| 7,410,106 | B2 | 8/2008 | Escoto, Jr. et al. |
| 7,416,140 | B2 | 8/2008 | Camilleri et al. |
| 7,422,164 | B2 | 9/2008 | Matsumoto |
| D579,213 | S | 10/2008 | Aipa |
| D581,107 | S | 11/2008 | Schmon |
| D581,483 | S | 11/2008 | Bass et al. |
| D583,013 | S | 12/2008 | Wang |
| 7,458,612 | B1 | 12/2008 | Bennett |
| D588,231 | S | 3/2009 | Pellin |
| 7,533,678 | B2 | 5/2009 | Rosa |
| 7,540,434 | B2 | 6/2009 | Gohring et al. |
| 7,542,032 | B2 | 6/2009 | Kruse |
| 7,568,638 | B2 | 8/2009 | Gehrung |
| D604,394 | S | 11/2009 | Wang |
| 7,614,571 | B2 | 11/2009 | Camilleri et al. |
| D607,086 | S | 12/2009 | Kosaka |
| 7,624,869 | B2 | 12/2009 | Primer |
| D607,972 | S | 1/2010 | Wang |
| D608,858 | S | 1/2010 | Baltz et al. |
| D614,731 | S | 4/2010 | Wang |
| 7,694,893 | B2 | 4/2010 | Zittel et al. |
| 7,694,896 | B2 | 4/2010 | Turnbull et al. |
| D615,586 | S | 5/2010 | Kudimi |
| D616,022 | S | 5/2010 | Kudimi |
| D616,527 | S | 5/2010 | Anderson et al. |
| 7,765,876 | B1 | 8/2010 | Chen |
| D624,668 | S | 9/2010 | Noppe |
| 7,810,744 | B2 | 10/2010 | Schmon et al. |
| 7,819,341 | B2 | 10/2010 | Schmon et al. |
| D627,039 | S | 11/2010 | Yu |
| D627,432 | S | 11/2010 | Escoto et al. |
| 7,823,806 | B2 | 11/2010 | Schmon |
| D629,623 | S | 12/2010 | Lampe |
| 7,856,940 | B2 | 12/2010 | Wendler |
| 7,913,938 | B2 | 3/2011 | Cooper |
| 7,922,107 | B2 | 4/2011 | Fox |
| D637,269 | S | 5/2011 | Wang |
| D638,121 | S | 5/2011 | Villasana |
| D639,863 | S | 6/2011 | Langan |
| D641,067 | S | 7/2011 | Wang |
| D644,716 | S | 9/2011 | Gehrung |
| D644,803 | S | 9/2011 | Schmon |
| D645,094 | S | 9/2011 | Langan |
| 8,042,402 | B2 | 10/2011 | Brown et al. |
| D649,196 | S | 11/2011 | Langan |
| 8,052,071 | B2 | 11/2011 | Kruse |
| D655,347 | S | 3/2012 | Gehrung |
| 8,127,963 | B2 | 3/2012 | Gerson et al. |
| D657,276 | S | 4/2012 | Brose |
| D661,492 | S | 6/2012 | Ranschau |
| D661,742 | S | 6/2012 | Clark |
| D663,960 | S | 7/2012 | Jeronimo |
| 8,225,892 | B2 | 7/2012 | Ben-Tzvi |
| D664,773 | S | 8/2012 | Papin |
| 8,240,579 | B1 | 8/2012 | Bennett |
| 8,297,536 | B2 | 10/2012 | Ruda |
| D670,085 | S | 11/2012 | Brookman et al. |
| D671,988 | S | 12/2012 | Leipold |
| D672,012 | S | 12/2012 | Brose et al. |
| D674,880 | S | 1/2013 | Schmon |
| 8,352,744 | B2 | 1/2013 | Kruse |
| 8,360,345 | B2 | 1/2013 | Micheli |
| D681,162 | S | 4/2013 | Kruse |
| 8,444,067 | B2 | 5/2013 | Schmon et al. |
| 8,454,759 | B2 | 6/2013 | Selsvik |
| 8,481,124 | B2 | 7/2013 | Nolte et al. |
| D689,590 | S | 9/2013 | Brose |
| D689,593 | S | 9/2013 | Schmon |
| D690,799 | S | 10/2013 | Maier |
| D692,530 | S | 10/2013 | Gehrung |
| D692,532 | S | 10/2013 | Li et al. |
| 8,616,434 | B2 | 12/2013 | Wilen |
| D697,584 | S | 1/2014 | Schmon |
| D698,008 | S | 1/2014 | Schmon et al. |
| 8,626,674 | B2 | 1/2014 | Whitehouse |
| 8,642,131 | B2 | 2/2014 | Nolte et al. |
| D704,300 | S | 5/2014 | Li et al. |
| 8,757,182 | B2 | 6/2014 | Schmon |
| 8,807,460 | B2 | 8/2014 | Charpie et al. |
| 8,857,732 | B2 | 10/2014 | Brose |
| D720,015 | S | 12/2014 | Kruse |
| D720,041 | S | 12/2014 | Robinson |
| 8,899,501 | B2 | 12/2014 | Fox et al. |
| D721,785 | S | 1/2015 | Gehrung |
| 8,925,836 | B2 | 1/2015 | Dettlaff |
| D733,369 | S | 6/2015 | Tschan |
| D733,453 | S | 7/2015 | Tschan |
| D734,428 | S | 7/2015 | Wang |
| D734,429 | S | 7/2015 | Wang |
| D734,571 | S | 7/2015 | Tschan |
| 9,073,068 | B2 | 7/2015 | Krayer et al. |
| D737,126 | S | 8/2015 | Tschan |
| D740,393 | S | 10/2015 | Gehrung |
| D745,636 | S | 12/2015 | Lin |
| D757,216 | S | 5/2016 | Gherung |
| D758,533 | S | 6/2016 | Gehrung |
| D758,537 | S | 6/2016 | Gehrung |
| D768,820 | S | 10/2016 | Binz |
| D770,593 | S | 11/2016 | Gehrung |
| D792,557 | S | 7/2017 | Wang |
| D794,756 | S | 8/2017 | Wang |
| 9,782,784 | B2 | 10/2017 | Schmon et al. |
| 9,878,336 | B2 | 1/2018 | Gehrung |
| D835,235 | S | 12/2018 | Gehrung et al. |
| 10,189,037 | B2 | 1/2019 | Schmon et al. |
| 2001/0004996 | A1 | 6/2001 | Schmon |
| 2001/0040192 | A1 | 11/2001 | Kaneko et al. |
| 2002/0134861 | A1 | 9/2002 | Petrie et al. |
| 2002/0148501 | A1 | 10/2002 | Shieh |
| 2002/0170978 | A1 | 11/2002 | Mohn |
| 2003/0025000 | A1 | 2/2003 | Schmon et al. |
| 2003/0066218 | A1 | 4/2003 | Schweikert |
| 2003/0121476 | A1 | 7/2003 | McIntyre et al. |
| 2003/0127046 | A1 | 7/2003 | Zehner et al. |
| 2003/0164408 | A1 | 9/2003 | Schmon |
| 2003/0177979 | A1 | 9/2003 | Crum et al. |
| 2003/0189105 | A1 | 10/2003 | Schmon |
| 2003/0209568 | A1 | 11/2003 | Douglas et al. |
| 2003/0213857 | A1 | 11/2003 | Schmon et al. |
| 2003/0218596 | A1 | 11/2003 | Eschler |
| 2003/0230636 | A1 | 12/2003 | Rogers |
| 2004/0046051 | A1 | 3/2004 | Santa Cruz et al. |
| 2004/0050432 | A1 | 3/2004 | Breda |
| 2004/0104194 | A1 | 6/2004 | Dennison |
| 2004/0129738 | A1 | 7/2004 | Stukas |
| 2004/0140373 | A1 | 7/2004 | Joseph et al. |
| 2004/0155063 | A1 | 8/2004 | Hofeldt |
| 2004/0177890 | A1 | 9/2004 | Weinmann |
| 2004/0191406 | A1 | 9/2004 | Crum et al. |
| 2004/0217201 | A1 | 11/2004 | Ruda |
| 2004/0233223 | A1 | 11/2004 | Schkolne et al. |
| 2004/0245208 | A1 | 12/2004 | Dennison |
| 2005/0056613 | A1 | 3/2005 | King |
| 2005/0082249 | A1 | 4/2005 | King |
| 2005/0127201 | A1 | 6/2005 | Matsumoto |
| 2005/0145723 | A1 | 7/2005 | Blette et al. |
| 2005/0145724 | A1 | 7/2005 | Blette et al. |
| 2005/0178854 | A1 | 8/2005 | Dodd |
| 2005/0218246 | A1* | 10/2005 | Chatron ..... B05B 7/0815 239/290 |
| 2005/0220943 | A1 | 10/2005 | Abrams et al. |
| 2005/0248148 | A1 | 11/2005 | Schenck et al. |
| 2005/0252993 | A1 | 11/2005 | Rogers |
| 2005/0252994 | A1 | 11/2005 | Rogers |
| 2005/0268949 | A1 | 12/2005 | Rosa |
| 2005/0284963 | A1 | 12/2005 | Reedy |
| 2006/0000927 | A1 | 1/2006 | Ruda |
| 2006/0007123 | A1 | 1/2006 | Wilson et al. |
| 2006/0048803 | A1 | 3/2006 | Jessup et al. |

(56) References Cited

U.S. PATENT DOCUMENTS

| | | | |
|---|---|---|---|
| 2006/0081060 | A1 | 4/2006 | Forster |
| 2006/0113409 | A1 | 6/2006 | Camilleri et al. |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0131795 | A1 | 6/2007 | Abbate et al. |
| 2007/0158349 | A1 | 7/2007 | Schmon et al. |
| 2007/0205305 | A1 | 9/2007 | Vagedes |
| 2007/0221754 | A1 | 9/2007 | Gehrung |
| 2007/0252378 | A1 | 11/2007 | Chambers |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2008/0296410 | A1 | 12/2008 | Carey et al. |
| 2009/0014557 | A1 | 1/2009 | Schmon et al. |
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri et al. |
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0021646 | A1 | 1/2010 | Nolte et al. |
| 2010/0059533 | A1 | 3/2010 | Unger et al. |
| 2010/0084493 | A1 | 4/2010 | Troudt |
| 2010/0108783 | A1 | 5/2010 | Joseph et al. |
| 2010/0126541 | A1 | 5/2010 | Schmon |
| 2010/0206963 | A1 | 8/2010 | Huang |
| 2010/0270390 | A1* | 10/2010 | Reitz ..... B05B 7/0815 239/8 |
| 2010/0270400 | A1 | 10/2010 | Evar et al. |
| 2011/0024524 | A1 | 2/2011 | Fox |
| 2011/0121103 | A1 | 5/2011 | Carleton et al. |
| 2011/0125607 | A1 | 5/2011 | Wilen |
| 2011/0127767 | A1 | 6/2011 | Wicks et al. |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2012/0187220 | A1 | 7/2012 | Micheli et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0263686 | A1 | 9/2014 | Hedger |
| 2014/0305962 | A1 | 10/2014 | Tschan |
| 2015/0165463 | A1 | 6/2015 | Gehrung |
| 2015/0231655 | A1 | 8/2015 | Adams et al. |
| 2016/0030960 | A1 | 2/2016 | Gehrung |
| 2018/0050356 | A1 | 2/2018 | Gehrung |
| 2018/0050361 | A1 | 2/2018 | Gehrung |
| 2018/0050362 | A1 | 2/2018 | Gehrung et al. |
| 2018/0133727 | A1 | 5/2018 | Schmon et al. |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 201064746 | Y | 5/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| CN | 203508251 | U | 4/2014 |
| CN | 203737474 | U | 7/2014 |
| CN | 204294401 | U | 4/2015 |
| DE | 460381 | | 5/1928 |
| DE | 510362 | | 10/1930 |
| DE | 611325 | C | 3/1935 |
| DE | 1425890 | | 11/1968 |
| DE | 2559036 | | 9/1976 |
| DE | 2653981 | | 6/1978 |
| DE | 2950341 | | 7/1980 |
| DE | 2926286 | A1 | 1/1981 |
| DE | 3016419 | | 11/1981 |
| DE | 8024829.9 | | 9/1982 |
| DE | 3111571 | A1 | 10/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | G 94 16 015.5 | U1 | 11/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |

(56) References Cited

FOREIGN PATENT DOCUMENTS

| | | | |
|---|---|---|---|
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 20320781 | | 6/2005 |
| DE | 10 2004 014 646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 021 298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 20 2010 012 449 | U1 | 12/2010 |
| DE | 202010012449 | | 12/2010 |
| DE | 102009032399 | A1 | 1/2011 |
| DE | 102009053449 | | 2/2011 |
| DE | 102010060086 | | 4/2012 |
| DE | 102011106060 | | 1/2013 |
| DE | 102011118120 | | 5/2013 |
| EM | 002066910-0001 | | 3/2013 |
| EM | 002066910-0002 | | 3/2013 |
| EM | 002066910-0003 | | 3/2013 |
| EM | 002066910-0004 | | 3/2013 |
| EM | 002066910-0005 | | 3/2013 |
| EM | 002066910-0006 | | 3/2013 |
| EM | 002066910-0007 | | 3/2013 |
| EM | 002066910-0008 | | 3/2013 |
| EM | 002066910-0009 | | 3/2013 |
| EM | 002066910-0010 | | 3/2013 |
| EP | 0092392 | | 10/1983 |
| EP | 0313958 | A2 | 5/1989 |
| EP | 524408 | | 1/1993 |
| EP | 567325 | | 10/1993 |
| EP | 0631821 | | 1/1995 |
| EP | 0650766 | | 5/1995 |
| EP | 0650766 | A2 | 5/1995 |
| EP | 678334 | | 10/1995 |
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1 247 586 | | 10/2002 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1997561 | A2 | 12/2008 |
| EP | 2017010 | A2 | 1/2009 |
| EP | 2027931 | | 2/2009 |
| EP | 2092987 | A1 | 8/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| EP | 2 669 213 | A1 | 12/2013 |
| EP | 2703089 | A1 | 3/2014 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 657854 | A | 9/1951 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | 58-119862 | | 5/1983 |
| JP | S5998757 | | 6/1984 |
| JP | S601722 | | 1/1985 |
| JP | H01-87805 | | 6/1989 |
| JP | H02258076 | A | 10/1990 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H08196950 | A | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| JP | 2008018296 | A | 1/2008 |
| JP | 2010-528837 | A | 8/2010 |
| TW | 491092 | | 6/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 1998/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |

(56) References Cited

FOREIGN PATENT DOCUMENTS

| | | | |
|---|---|---|---|
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009/054986 | A1 | 4/2009 |
| WO | 2009056424 | | 5/2009 |
| WO | 2010019274 | A1 | 2/2010 |
| WO | 2010/044864 | A1 | 4/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |
| WO | 2013/131626 | A1 | 9/2013 |

OTHER PUBLICATIONS

Written Opinin for International Application No. PCT/EP2016/000809, filed May 17, 2016.
Response to Final Office Action and RCE dated Nov. 29, 2016 in U.S. Appl. No. 14/113,649.
Restriction Requirement Office Action dated Aug. 28, 2018 in U.S. Appl. No. 15/679,533.
Restriction Requirement Office Action dated Aug. 28, 2018 in U.S. Appl. No. 15/679,461.
Notice of Allowance dated Sep. 14, 2018 in U.S. Appl. No. 29/618,945.
Notice of Allowance dated Sep. 14, 2018 in U.S. Appl. No. 14/113,649.
Office Action from U.S. Appl. No. 15/143,698 dated Jan. 5, 2017.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 5 pages.
Office Action dated Feb. 19, 2016 for U.S. Appl. No. 14/113,649.
Final Office Action dated Feb. 25, 2016 for U.S. Appl. No. 13/698,417.
Restriction Requirement dated Mar. 25, 2016 for Design U.S. Appl. No. 29/516,082.
Response filed Mar. 31, 2016 to Office Action dated Dec. 31, 2016 for U.S. Appl. No. 14/572,998.
Printout from Internet www.ehow.com explaining how to choose a spray gun and stating in item 2 "Nozzle sizes vary between about 1 mm and 2 mm.", printed Sep. 7, 2012.
Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012.
Printout from Internet of pages from brochure of Walther Pilot showing nozzle sizes for spray guns ranging from 0.3 mm to 2.5 mm, dated 2007.
Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012.
Printout from Internet of p. 28 from current 3Mtm brochure showing Tip/Nozzle/Air Cap Selection Guide with nozzle sizes from 0.5 mm to 3.0 mm.
Decision by EPO regarding opposition proceedings to revoke patent No. 99926841.0-2425/ 1108476, corresponding to '387 patent, 2012.
SATA News Publication Dan-Am Jul.-Sep. 1996.
SATA News Publication Dan-Am Oct.-Dec. 1996.
SATA News Publication Dan-Am Apr.-Jun. 1998.
Dan-Am SATA Catalog 6 for spray guns 1991.
Dan-Am SATA Catalog 8 for spray guns 1994.
Dan-Am Catalog 6—51pp published 1991, (Exhibit 1042 in IPR 2013-0111).
Japanese Industrial Standards B 9809 English translation, 1992.
Japanese Industrial Standards B 9809 revised Mar. 1, 1991.
SATA News, vol. 21, 2009.
Collision Hub TV Document (image from video clip) printed Oct. 9, 2013.
MyRielsMe.com document from press release printed Oct. 9, 2013.
How to set Air pressure, Utube screenshot printed Oct. 9, 2013.
Ohio EPA Letty to Tony Larimer, response to letter dated Aug. 2006.
Pinahs Ben-Tzvi et al, A conceptual design . . . , Mechatrronics 17 (2007) p. 1-13.
On line ad from Amazon.com printed Oct. 14, 2013.
Rone et al, MEMS-Baed Microdroplet Generation with Integrated Sensing, COMSOL, 2011.
Final Office Action dated Dec. 7, 2017 for U.S. Appl. No. 14/815,210.
Office Action dated Jun. 30, 2017 for U.S. Appl. No. 14/815,210.
Final Office Action dated Sep. 12, 2018 in U.S. Appl. No. 14/815,210.
European Search Report dated Jan. 24, 2018 for Application No. 17186905.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued against JP Patent App. 2012-508926 dated Feb. 25, 2014 with English translation.

(56) References Cited

OTHER PUBLICATIONS

Response filed Dec. 21, 2015 to Office Action dated Jul. 20, 2015 for U.S. Appl. No. 14/113,649.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
International Search Report dated Aug. 31, 2016 for PCT/EP2016/061057 filed May 18, 2016.
Written Opinion for PCT/EP2016/061057 filed May 18, 2016.
Response restriction requirement filed May 23, 2016 for Design U.S. Appl. No. 29/516,082.
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited Jan. 7, 2015], <http://www.herkules.us/pdfs/L00761-Hercules-Gun_Washers-4-page-brochure.pdf>.
Jetclean Gun Cleaner Terry's Auto Supply, google publish date Aug. 4, 2011, [online], [site visited Jan. 7, 2015], <http://secure.terrys.net/viewProduct.php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Response to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dared Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Extended European Search Report dated Apr. 17, 2015 for European Application No. 14004167.4.
European Search Report dated May 8, 2017 for Application No. EP16203544.
"Spray Guns/sata.com", Oct. 18, 2015, XP055364928 URL:http://web.archive.org/web/20151018205307/http://www.sata.com/index.php?id=lackierpistolen&L=11 [gefunden am Apr. 13, 2017]; reprinted on Dec. 8, 2017.
"SATAjet 5000 B Lackierpistolen | Bechersysteme | Atemschutz | Filtertechnik | Zubehor So flexibel wie Ihre Aufgaben" Apr. 11, 2017, XP055364477 Gefunden im Internet: URL:https/www.sata.com/uploads/tx_pxspecialcontent/00_SATAjet_5000_B.pdf [gefunden am Apr. 12, 2017]; English translation of full brochure attached.
Amendments submitted to European Patent Office dated Dec. 3, 2017 for Application No. EP16203544 (with English translation of chart on p. 3).
May 22, 2018 Final Office Action for U.S. Appl. No. 14/113,649.
Office Action, dated Jan. 9, 2019, for U.S. Appl. No. 15/679,482.
Notice of Allowance dated Jan. 27, 2016 for Design U.S. Appl. No. 29/510,723.
Notice of Allowance dated Apr. 18, 2016 for U.S. Appl. No. 14/572,998.
Response filed Apr. 27, 2016 to Office Action dated Jan. 29, 2016 for U.S. Appl. No. 13/380,949.
German Search Report dated Apr. 12, 2016 for related German Application No. 10 2015 008 735.5.
Response to Office Action filed Feb. 16, 2016 for U.S. Appl. No. 13/698,417.
Screen shot of a SATA product (SATAjet B) description retrieved on Feb. 12, 2016 from www.sata.com/index.php.
"The Hot Rolling Process;" California Steel; retrieved on Feb. 12, 2016 from http://www.californiasteel.com/GetPublicFile.aspx?id=53.
Final Office Action in U.S. Appl. No. 14/113,649 dated Jun. 22, 2017.
Response filed in U.S. Appl. No. 15/143,698 dated Jul. 3, 2017.
Written Opinion dated Sep. 8, 2016 for International Application No. PCT/EP2016/061057 filed May 18, 2016.
German Search Report for Application No. 10 2016 009 957.7 dated Apr. 21, 2017.
Restriction Requirement Office Action dated Apr. 17, 2017 for U.S. Appl. No. 14/815,210.
Notice of Allowance dated Apr. 10, 2017 for U.S. Appl. No. 29/579,824.
Response to Final Office Action filed May 9, 2017 in U.S. Appl. No. 13/698,417.

(56) References Cited

OTHER PUBLICATIONS

Response to Office Action filed May 17, 2017 in U.S. Appl. No. 14/113,649.
International Preliminary Report on Patentability for PCT/EP2015/001728 filed Aug. 25, 2015.
Final Office Action dated Mar. 16, 2017 from U.S. Appl. No. 13/698,417, 9 pages.
Office Action dated Dec. 31, 2015 for U.S. Appl. No. 14/572,998.
Notice of Allowance dated Jan. 19, 2016 for Design U.S. Appl. No. 29/539,615.
Notice of Allowance dated Jan. 22, 2016 for U.S. Appl. No. 13/991,285.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Response to Restriction Requirement filed in U.S. Appl. No. 14/815,210 dated Jun. 19, 2017.
Response to Office Action dated Jun. 25, 2018 for U.S. Appl. No. 14/815,210.
Response to Final Office Action dated Aug. 22, 2018 for U.S. Appl. No. 14/113,649.
Office Action dated Aug. 7, 2015 for U.S. Appl. No. 13/991,285.
Office Action, dated Jan. 15, 2019, for U.S. Appl. No. 15/679,533.
Office Action, dated Jan. 15, 2019, for U.S. Appl. No. 15/679,461.
U.S. Appl. No. 14/815,210 Office Action dated Apr. 3, 2018.
U.S. Appl. No. 14/113,649 Response filed Mar. 3, 2018.
German Search Report dated Apr. 10, 2018 for Application No. 10 2017 118 599.2.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Response to Election of Species Requirement and Amendment filed Oct. 15, 2018 from U.S. Appl. No. 15/679,482.
Chinese Search Report dated Jul. 18, 2018 for Application No. 2014103745834 filed Jul. 31, 2014.
DesignView of CN302452159 registered Jun. 5, 2013, printed Oct. 18, 2018.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
Office Action dated Nov. 2, 2016 for U.S. Appl. No. 11/949,122.
Restriction Requirement dated Mar. 18, 2019, for U.S. Appl. No. 29/596,869.
Office Action dated Mar. 15, 2019, for U.S. Appl. No. 14/815,210.

* cited by examiner

AIR CAP AND NOZZLE ASSEMBLY FOR A SPRAY GUN, AND SPRAY GUN

FIELD OF THE DISCLOSURE

The disclosure relates to an air cap for a spray gun, in particular a paint spray gun, to a nozzle assembly for a spray gun, in particular a paint spray gun, and to a spray gun, in particular a paint spray gun.

BACKGROUND

According to the prior art, a spray gun, in particular a paint spray gun, at the head thereof has a paint nozzle which is screwed into the gun body. The paint nozzle at the front end thereof often has a hollow-cylindrical small plug, the material to be sprayed exiting from the front mouth thereof during operation of the spray gun. However, the paint nozzle in the front region thereof may also be conically designed. The gun head typically has an external thread by way of which an annular air nozzle having an air cap disposed therein is screwed to the gun head. The air cap has a central opening, the diameter thereof being larger than the external diameter of the small paint-nozzle plug, or of the external diameter of the front end of a conical paint nozzle, respectively. The central opening of the air cap and the small plug, or the front end of the paint nozzle, respectively, conjointly form an annular gap. The so-called atomizing air exits from this annular gap, said atomizing air in the above-described nozzle assembly generating a vacuum on the end face of the paint nozzle, on account of which the material to be sprayed is suctioned from the paint nozzle. The atomizing air impacts the paint jet, on account of which the paint jet is torn apart so as to form threads and tapes. On account of the hydrodynamic instability thereof, the interaction between the rapidly flowing compressed air and the ambient air, and by virtue of aerodynamic disruptions, these threads and tapes disintegrate so as to form droplets which are blown away from the nozzle by the atomizing air.

The air cap furthermore often has two horns which are diametrically opposed, in the outflow direction projecting beyond the mentioned annular gap and the material outlet opening. Two supply bores, that is to say horn air infeed ducts, run from the rear side of the air cap towards horn air ducts in the horns. Each horn typically has at least one horn air duct, each horn preferably having at least two horn air ducts, however. Each horn air duct on the external side thereof has a horn air opening from which the horn air exits. The horn air ducts or openings, respectively, are typically oriented such that the former in the exit direction point in the nozzle longitudinal axis towards the annular gap, such that the so-called horn air exiting from the horn air openings may influence the air or the paint jet, respectively, that has already exited from the annular gap, or the paint mist that has at least been partially created already. On account thereof, the originally conical cross section of the paint jet (round jet) or of the paint mist, respectively, at the sides thereof that face the horns is compressed and is slightly elongated in the direction that is perpendicular thereto. On account thereof, a so-called wide jet which permits a higher planar coating rate is created. Apart from deforming the paint jet, the horn air has the effect of further atomizing the paint jet.

So-called control openings may be incorporated into the front face of the air cap, so as to be radially outside the central opening. The air that exits from the control openings influences the horn air, the former in particular cushioning the impact of the horn air on the paint jet. Furthermore, the control air protects the air cap from contamination in that the former conveys paint droplets away from the air cap. Moreover, said control air contributes towards further atomization of the paint mist. The control air also acts on the round jet, causing a slight pre-deformation as well as additional atomizing here too.

Such a nozzle arrangement is above all suitable for use with a spray gun, in particular a paint spray gun, wherein not only paints but also adhesives or lacquers, in particular base and clear lacquers, both solvent-based as well as water-based, but likewise liquids for the food industry, wood-treatment agents, or other liquids may be sprayed. Spray guns may be classified in particular as hand-held spray guns and as automatic or robotic guns, respectively. Hand-held spray guns are used above all by tradesmen, in particular by painters, joiners and varnishers. Automatic and robotic guns are typically used in conjunction with a painting robot or a painting machine for industrial applications. However, it is readily conceivable for a hand-held spray gun to be integrated in a painting robot or in a painting machine.

The spray gun may have the following in particular: a grip, an upper gun body, a compressed-air connector, a trigger for opening an air valve and for moving the paint needle out of the material outlet opening of the paint nozzle, a round/wide jet regulator for setting the ratio of atomizing air to horn air in order for the paint jet to be shaped, an air micrometer for setting the spray pressure, a material-amount regulator for setting the maximum volumetric material flow, a material connector, paint ducts for conducting the material to be sprayed from a material inlet to the material outlet, compressed-air ducts, in particular wide-jet ducts for supplying the horns with air, and round-jet ducts for supplying the annular gap and the control openings with air, a suspension hook, and an analogue or digital pressure-measuring installation. However, said spray gun may also have other components from the prior art. The paint spray gun may be designed as a flow-cup spray gun, having a paint cup that is disposed above the gun body and from which the material to be sprayed flows substantially by way of gravity and by negative pressure at the front end of the paint nozzle into and through the paint ducts. However, the spray gun may also be a side-cup gun in which the paint cup is disposed laterally on the gun body, and in which the material is likewise infed to the gun by gravity and by negative pressure at the front end of the paint nozzle. However, the spray gun may also be as a suction-cup gun, having a paint cup that is disposed below the gun body, from which the material to be sprayed is suctioned substantially by negative pressure, in particular while utilizing the Venturi effect, from the cup. Furthermore, said spray gun may be designed as a pressurized-cup gun in which the cup is disposed below, above, or laterally on the gun body and is impinged with pressure, whereupon the medium to be sprayed is squeezed out of the cup. Furthermore, said spray gun may be a bucket gun in which the material to be sprayed is infed to the spray gun from a paint container by means of a hose or by way of a pump.

The above-described nozzle arrangement and spray gun have been successful for many years. The quality of the spray result depends to a large extent on the quality of the spray gun used. High-quality spray guns are manufactured with high precision to very tight production tolerances, since even deviations from the ideal dimension in the range of a few hundredths of millimeters may negatively influence the quality of atomization and thus the spray result. The quality of atomization is further determined by the accurate design of the so-called nozzle set. The nozzle set is typically composed of the air nozzle, the paint nozzle, and the paint needle. The air nozzle in turn is composed of the air cap and the annular air nozzle. The diameter of the needle tip, the internal diameter of the central opening in the air cap, of the horn air openings, and of the control openings, the angles of the openings or ducts, respectively, in relation to the central axis of the central opening, and the mutual alignment of the openings or ducts, respectively, are all relevant to the spray quality in particular.

A good atomization quality is particularly important in the application of clear and base lacquers (solid paints) to vehicles and vehicle parts. An inadequate spray quality has negative effects on the accuracy of the colour shade and the lustre of the coating in particular in the case of repair paintwork. Since the repainted vehicle part often is disposed directly next to a part having the original paintwork, any inaccuracies are clearly in evidence here. A complaint by the customer of the vehicle paint shop necessitates rework which is associated with a high expense in terms of time and costs.

It has been established in the context of spray tests that the quality of the coating does not depend only on the fineness of atomization but to a large extent also on the profile of the layer thickness of the coating across the length or height, respectively, of the spray jet, or of the spray pattern, respectively. A spray pattern is usually established in that paint or lacquer is applied by means of the spray gun, without moving the spray gun, from a specific distance, for example 15 cm to 20 cm, in front of a substrate, for example paper, a paper having a scale that is intended for establishing a spray pattern, or a sheet-metal panel. The spray duration is approx. 1 to 2 seconds. Alternatively, the spray gun may be moved by means of a device, in particular perpendicularly to the longitudinal axis of the wide jet, keeping a constant distance from the sheet-metal panel or paper. The shape of the spray pattern that has been generated in this way, and the size of the droplets on the substrate, provide a conclusion pertaining to the quality of the spray gun, in particular of the nozzles.

The layer thickness of the spray pattern may be ascertained pre or post drying of the spray pattern by means of methods known in the prior art, for example by means of layer-thickness measuring apparatuses, or the paint droplets and the size and position thereof is detected still during the flight towards the substrate, for example by means of a laser diffraction method.

A spray pattern as has been described above, across the length and the width thereof, does not have a uniform layer thickness. The central core of the spray pattern has a high layer thickness, the layer thickness generated outside the core being less. The transition in the layer thickness between the core and the external region is fluid. If the layer thickness is plotted across the length of the spray pattern, an initially flat ascent from the left to the right results, said ascent marking the external periphery of the external region. The core thickness increases relatively steeply in the proximity of the core, and in the ideal case remains substantially constant across the longitudinal profile of the core, that is to say that a plateau is displayed. The layer thickness drops relatively steeply at the periphery of the core, followed by a flatter descent towards the end of the external region. It has been demonstrated that a more uniform coating of improved quality may be generated the steeper the transition is between the core region and the external region, that is to say the steeper the profile of the layer thickness is across the length of the spray pattern when transitioning from the external region to the core region. During the painting procedure, the painter moves the activated spray gun in meandering tracks, wherein the tracks mutually overlap in a region of between 30% to 50% of the height of said tracks, that is to say that approximately the lower or the upper third of one track overlaps the upper or lower third of the preceding track, respectively. A core region of higher definition enables the painter to apply the core regions of the spray tracks during the painting procedure in as mutually adjacent a manner as possible such that a uniform overall layer thickness is created. However, the transition must also not be too steep since there is otherwise the risk of excessive coating, for example by inadvertently applying the double coating thickness, leading to so-called paint tears. The experiments have furthermore demonstrated that it is advantageous for the above-mentioned plateau to be as wide as possible, that is to say for the core region of the spray pattern having the maximum layer thickness to be as long as possible.

SUMMARY

Accordingly, at least some embodiments disclosed provide an air cap for a spray gun, a nozzle assembly for a spray gun, and a spray gun, by way of which a better coating quality is achieved than by way of air caps, nozzle assemblies, and spray guns according to the prior art. In particular, the intention is to provide an air cap for a spray gun, a nozzle assembly for a spray gun, and a spray gun, which generate a spray pattern in which the coating thickness across the length of the spray pattern in the transition from an external region of the spray pattern to a core region increases as steeply as possible, and in which the core of the spray pattern, that is to say the region having the maximum coating thickness, is as long as possible. At the same time, despite the comparatively large core region, the spray jet is not to become too dry, and the transition from an external region of the spray pattern to a core region is not to be steep in such a manner that there is a risk of excessive coating.

In an embodiment, an air cap for a spray gun, in particular a paint spray gun, has at least one central opening, which is delimited by a mouth, and two horns, each having at least one inner and one outer horn air duct and one inner and one outer horn air opening, wherein the spacing between the front end of the central opening and an axis which perpendicularly intersects the central axis of the central opening and runs through the centre of an inner horn air opening is between 0.6 mm and 2.6 mm. This is to mean the shortest spacing between the front end of the central opening, that is to say the centre of the frontmost face of the central opening, and the intersection point of the central axis of the central opening and an axis which perpendicularly intersects the central axis of the central opening and runs through the centre of an inner horn air opening. This spacing is the so-called spot bore height of the inner horn air duct. The inner horn air ducts or openings, respectively, are those horn air ducts or openings, respectively, that are located closer to the central opening of the air cap. By contrast, the outer horn air ducts or openings, respectively, are those horn air ducts or openings, respectively, that are more remote from the central opening of the air cap and are located closer to the front end of the horn. The inner horn air ducts of the two horns of the air cap preferably have identical spot bore heights. The term "spot bore height" does not by default mean that the horn air ducts have to be incorporated into the horns by boring. The term is merely owed to the procedure according to the prior art, wherein the horn air ducts are bored into the horns. However, said horn air ducts may also be incorporated into the horns by means of a laser, or the air cap may be manufactured by means of 3D-printing, casting, or die casting, wherein the horn air ducts and other ducts and openings of the air cap are omitted. Accordingly, the horn air ducts, like other ducts and openings of the air cap, need not have a circular cross section; rather, said ducts and openings may also at least in part have a square, rectangular, triangular, oval, or other cross section. In the case of air caps according to the prior art, the spot bore height is more than 2.6 mm. A reduction in the spot bore height demonstrated one of the above-mentioned desired effects, specifically a longer core region of the spray pattern, that is to say a wider plateau in the profile of the coating thickness across the length of the spray pattern.

In an embodiment, a nozzle assembly for a spray gun, in particular a paint spray gun, has at least one paint nozzle, wherein said nozzle assembly furthermore has an above-mentioned air cap.

In an embodiment, a spray gun, in particular a paint spray gun, has an above-mentioned air cap or an above-mentioned nozzle assembly.

Advantageous design embodiments are also disclosed.

An air cap in which the spacing between the front end of the central opening and an axis which perpendicularly intersects the central axis of the central opening and runs through the centre of an inner horn air opening is between 2.4 mm and 2.6 mm is particularly preferable. Spraying experiments have shown that the spot bore height of the inner horn air ducts cannot be reduced in an arbitrary manner. While a further widening of the above-mentioned plateau indeed results, the sprayed material by virtue of the constant throughput of material is distributed across a larger core region, and the spray jet becomes too dry. A spot bore height between 2.4 mm and 2.6 mm for the inner horn air ducts has been established as a good compromise between as wide a plateau as possible and adequate wetness, that is to say an adequate coating thickness, while the air cap, in particular in terms of the control bores, is otherwise designed in the same manner. If and when the spot bore height is further reduced, further adaptation of the air cap becomes necessary, as will be described in more detail further below.

In the case of one preferred embodiment of the air cap according to the disclosure, the angle between the central axis of an inner horn air duct and the central axis of the central opening is between 53° and 60°, particularly preferably between 57° and 60°. The angle is enlarged in comparison to standard air caps, that is to say to air caps according to the prior art.

In the case of the air cap according to the disclosure, the spacing between the front end of the central opening and an axis which perpendicularly intersects the central axis of the central opening and runs through the centre of an outer horn air opening is preferably between 6.0 and 6.6 mm, particularly preferably between 6.2 and 6.4 mm. According to the above description this is to mean the shortest spacing between the front end of the central opening, that is to say the centre of the frontmost face of the central opening, and the intersection point of the central axis of the central opening and an axis which perpendicularly intersects the central axis of the central opening and runs through the centre of an outer horn air opening. This spacing is the spot bore height of the outer horn air duct. In the case of conventional nozzles, the spot bore height of the outer nozzles is approximately 5 mm to 6 mm. In the case of the present disclosure, the spot bore height has thus been increased, the outer horn air ducts or openings, respectively, having been placed further towards the outside. The length of the horns may remain the same as in the prior art, but the horns may also be extended in length.

The angle between the central axis of an outer horn air duct and the central axis of the central opening is preferably between 78° and 82°, particularly preferably between 79° and 80.5°. The angle has been enlarged in comparison to standard nozzles in which the angle is below 75°. As is the case with the inner horn air ducts, the enlargement of the angles causes a harder impact of the horn air on the paint jet and thus improved atomizing.

In the context of the present disclosure the angle between the central axis of an outer horn air duct and the central axis of the central opening is defined as the spot bore angle of the outer horn air duct, the angle between the central axis of an inner horn air duct and the central axis of the central opening being defined as the spot bore angle of the inner horn air duct. The ratio of the spot bore angle of the outer horn air duct to the spot bore angle of the inner horn air duct is particularly preferably between 1.2 and 1.6. The spot bore angle of the outer horn air duct is thus 1.2 to 1.6 times the size of the spot bore angle of the inner horn air duct.

The spacing between an axis which perpendicularly intersects the central axis of the central opening and runs through the centre of an inner horn air opening, and an axis that, parallel with this axis, runs through the centre of an outer horn air opening is preferably between 3.3 mm and 5.8 mm, particularly preferably between 3.4 mm and 4.2 mm. This dimension is the spacing between the inner and the outer horn air opening along the central axis of the central opening, that is to say the difference between the spot bore heights of the inner and the outer horn air duct. The horn air openings in the case of the present disclosure are spaced wider apart than in the case of conventional nozzles in which the dimension is typically below 3 mm.

The internal diameter of at least one inner horn air opening is preferably between 1.1 mm and 1.3 mm, particularly preferably 1.2 mm.

The internal diameter of at least one outer horn air opening is preferably between 1.4 mm and 1.6 mm, in particular 1.5 mm.

As has already been mentioned above, the spacing between the front end of the central opening and an axis which perpendicularly intersects the central axis of the central opening and runs through the centre of an outer horn opening is the so-called spot bore height of the outer horn air opening. The ratio of the spot bore height of the outer horn air opening to the internal diameter of the outer horn air opening is preferably between 3.8 and 4.5.

Accordingly, the spacing between the front end of the central opening and an axis which perpendicularly intersects the central axis of the central opening and runs through the centre of an inner horn air opening is the spot bore height of the inner horn air opening. The ratio of the spot bore height of the inner horn air opening to the internal diameter of the inner horn air opening is preferably between 1.7 and 2.4.

The ratio of the spot bore height of the outer horn air opening to the spot bore height of the inner horn air opening is particularly preferably between 2.0 and 3.0.

The central axes of the inner and outer horn air ducts are preferably perpendicular to the faces into which the horn air ducts are incorporated. This has the advantage that the risk of the drill slipping away during boring of the horn air ducts is lower than in the case of the ducts being bored into a face which is inclined in relation to the central axis of the drill. The bores may be positioned more accurately. Furthermore, openings having a circular cross section are generated by perpendicular boring, this being particularly desirable in the present case. Openings having an elliptic cross section would be created in the case of boring of the ducts into a face which is inclined in relation to the central axis of the drill. The faces into which the bores are incorporated, that is to say the internal faces of the horns, may be curved.

The air cap in the region next to the mouth that delimits the central opening particularly preferably has control openings. These control openings which are preferably designed as bores reach into the interior of the air cap and therein are supplied with air. The air that exits from the control openings, the so-called control air, impacts the horn air exiting from the horn air openings, deflects the latter and spreads the horn air jet, that is to say widens the latter, damping the horn air jet. The control air also acts on the round jet, causing a slight deformation as well as additional atomization here too. In both cases, the control air contributes towards further atomization of the paint jet, reducing the contamination of the air cap by the spray mist, since said control air conveys the latter away from the air cap.

In particular, the air cap in each case may have three control openings that are disposed on two mutually opposite sides of the central opening and are disposed in the form of a triangle, wherein a tip of the triangle is aligned in the direction of the inner or outer horn air openings. The control openings may have the same diameter, advantageously between 0.5 mm and 0.6 mm.

In the case of one preferred exemplary embodiment of the air cap according to the disclosure, the spacing between the front end of the central opening and an axis which perpendicularly intersects the central axis of the central opening and runs through the centre of an inner horn air opening is between 0.6 mm and 1.2 mm, and the air cap in the region next to the mouth that delimits the central opening furthermore in each case has two control openings that are disposed on two mutually opposite sides of the central opening, wherein the control openings are disposed so as to be roughly in line with the inner or outer horn air openings. As has been described above, the spot bore height of the inner horn air opening may not be reduced in an arbitrary manner since the spray jet would otherwise become too dry. In order for this to be prevented, the design of the control openings is modified as described. Instead of the above-mentioned triangular arrangement of three control openings, a linear arrangement of two control openings is preferred. "Linear" means that in the plan view onto the air cap, a line through the horn air openings also runs through the control openings. This line is preferably a centreline.

An air cap in which the control openings that are disposed in the region next to the mouth that delimits the central opening in relation to the central axis of the central mouth enclose an angle of 8° to 12° is particularly preferred. Said control openings here are preferably inclined in the direction of the spray jet such that the control air may impact the horn air or the round jet. Particularly preferably, the angle of the inner control opening, that is to say that control opening that is disposed closer to the central opening, is between 9° and 11°, the angle of the outer control openings, that is to say those control openings that are disposed so as to be more remote from the central opening, being between 7° and 9°.

The central axes of the control openings are preferably perpendicular to the faces of the region into which the control openings are incorporated. In a manner similar to the horn air openings, this here too has the advantage that the risk of the drill slipping away during boring of the control openings is lower than in the case of the ducts being bored into a face which is inclined in relation to the central axis of the drill. The bores may be positioned more accurately. Furthermore, openings having a circular cross section are generated by perpendicular boring, this being particularly desirable in the present case. Openings having an elliptic cross section would be created in the case of boring of the openings into a face which is inclined in relation to the central axis of the drill.

An air cap in which the internal diameter of the central opening is between 3.5 mm and 3.7 mm is preferred. The wall thickness of the mouth that delimits the central opening is preferably between 0.60 mm and 0.75 mm, in particular in the front region thereof.

The mouth that delimits the central opening preferably has a conical external shape, wherein the central axis of the central opening in relation to the external face of the mouth that delimits the central opening encloses an angle of 25° to 35°. The flows that prevail on the air cap, in particular the spray jet, cause an entrainment of ambient air. It must be guaranteed that sufficient ambient air may flow in at all times, since turbulences that negatively influence the spray quality otherwise arise on the external region of the spray jet. For this reason, so as to enable a readier inflow of ambient air, the largest part of the air-nozzle front face is also designed so as to be slightly conical. However, the region about the mouth that delimits the central opening is chamfered in such a manner that the face in the direction of the mouth that delimits the central opening is slightly depressed. This chamfer also has the purpose of reducing the contamination of that region by the spray mist.

An air cap in which the central axes of an inner horn air opening and of an outer horn air opening intersect at a point that lies on the central axis of the central opening of the air cap is particularly preferable. The inner and outer horn air openings thus target the same point, or the same region on the spray jet, respectively. By virtue of the deflection and the spreading, that is to say the widening, of the horn air jet by the control air the actual impact point or region, respectively, of the horn air on the spray jet is more remote from the air cap than this intersection point of the central axes of the horn air openings and the central axis of the central opening. On account thereof it may furthermore be the case that the air from the inner horn air openings does not impact the spray jet in the same region as the air from the outer horn air openings.

The spacing between the front end of the central opening and the intersection point of the central axes of an inner horn air duct and of an outer horn air duct is preferably between 7.5 mm and 8.5 mm.

The ratio of the spacing of a horn air duct from the intersection point of the central axis of an outer control opening and the central axis of the horn air duct to the spacing of the intersection point of the central axis of the outer control opening and the central axis of the horn air duct from the intersection point of the central axis of the horn air duct and the central axis of the central opening of the air cap is preferably between 50:50 to 65:35. This means that the central axis of an outer control air opening intersects the central axis of at least one horn air opening approximately half-way between the horn air opening and the intersection point of the horn air opening and the central axis of the central opening, or is somewhat closer to the central axis of the central opening.

In the case of the air cap according to the disclosure, the centres of the horn air openings of both horns are preferably in line with the centre of the central opening. This means that in the plan view onto the air cap, a line through the centres of the horn air openings also runs through the centre of the central opening of the air cap. This line is preferably a centreline.

The air cap is preferably composed of brass which, prior to being coated preferably by a galvanic method, initially is hot-pressed into a shape that is similar to the completed air cap. The semi-finished product is subsequently machined to completion by turning various faces and boring the openings. Thereafter, the air cap may be connected to an annular air nozzle and be attached to a spray gun. Of course, the air cap may also be composed of another material, for example from another metal or from plastics, and be manufactured by means of a casting or die-casting method, or by means of 3D-printing, and may be non-coated or be coated by means of another coating method.

In the case of one preferred embodiment of the nozzle assembly according to the disclosure, the paint nozzle on the external side in the region of the front end thereof has at least three V-shaped slots, wherein the bases of the V-shaped slots converge towards the front, in the direction of a central axis of the paint nozzle. The depth of the V-shaped slots, that is to say of the slots having a V-shaped cross section, increases in the direction towards the paint outlet of the paint nozzle. The bases of the V-shaped slots may intersect the internal diameter of the paint nozzle already ahead of the front end of the paint nozzle, or the bases of the V-shaped slots may intersect the internal diameter of the paint nozzle substantially exactly at the front end of the paint nozzle. However, the bases of the V-shaped slots preferably do not intersect the internal diameter of the paint nozzle, that is to say that the bases of the V-shaped slots are spaced apart from the internal diameter of the paint nozzle at the front end of the paint nozzle. The V-shaped slots cause additional atomizing of the paint, in addition to the atomization at the central opening of the air cap. The bases of the slots in relation to the central axis of the paint nozzle preferably enclose an angle of 30° to 45°. In the case of this impact angle of the atomizing air onto the paint jet, the Sauter mean diameter (SMD) is at the minimum, and the uniformity of atomization is best. The front end face of the paint nozzle may be conically designed, that is to say that the paint nozzle widens in the direction of the outlet thereof. The opening angle is preferably between 80° and 100°. The internal face of the conical end face preferably does not intersect the external face of the paint nozzle at the front end of the paint nozzle, but a region of the front end face between the conical internal face and the cylindrical external face of the paint nozzle is designed so as to be planar. A vacuum that suctions the paint from the paint nozzle may be configured on this planar region when the atomizing air exits from the annular gap between the air cap and the paint nozzle.

The paint nozzle of a nozzle assembly according to the disclosure may be conically designed in the front region thereof. This means that the paint nozzle at the front end thereof does not have a small hollow-cylindrical plug, but that the atomizing air is guided into the paint jet substantially at an angle that corresponds to the angle of the external face of the conical paint nozzle in relation to the central axis of the paint nozzle. The angle of the external face of the conical paint nozzle in relation to the central axis of the paint nozzle preferably is between 30° and 45°, since the Sauer mean diameter (SMD) is at the minimum here, and the uniformity of atomization is best, as has already been described above.

The air cap according to the disclosure is particularly suitable for use in a nozzle assembly for a spray gun, in particular a paint spray gun. Said air cap may be used conjointly with an annular air nozzle and a paint nozzle with a spray gun. This herein may be all types of spray guns for spraying various media, as have been described above.

The spray gun may have a hollow needle which may be designed for conducting material for spraying or compressed air. For example, a higher throughput of material, or spraying bi-component material, is possible by way of a hollow needle that conducts material for spraying. To this end, the hollow needle is connected directly or indirectly to a supply of material. If and when the hollow needle is designed so as to conduct compressed air, said needle by way of expelling atomizing air may contribute towards atomizing the material for spraying. To this end, the hollow needle is connected directly or indirectly to a supply of compressed air. In all cases, the hollow needle may be designed for conducting an arbitrary volumetric flow. A person skilled in the art will be familiar with the fact that the throughput depends on the internal diameter of the hollow needle and on the input pressure and the volumetric flow.

The spray gun according to the disclosure may furthermore of course also have other components or design embodiments according to the prior art.

BRIEF DESCRIPTION OF THE DRAWINGS

The disclosure will be explained in more detail hereunder in an exemplary manner by means of the drawings in which.

DETAILED DESCRIPTION

Figure 1:
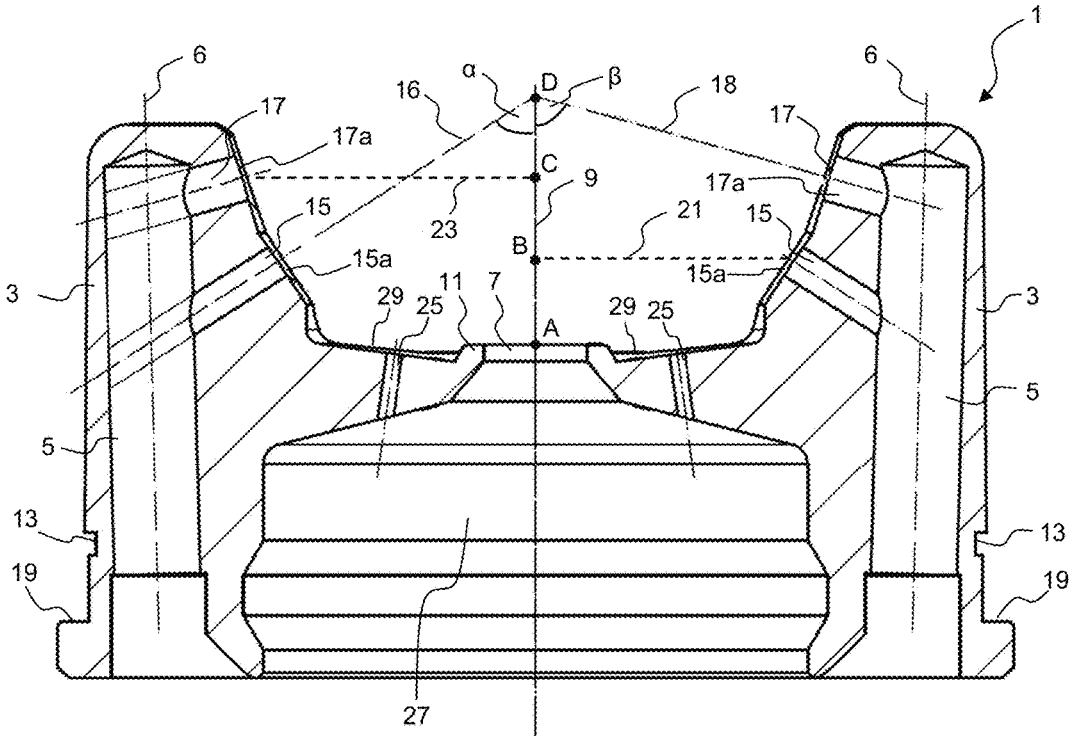
FIG. 1 shows an exemplary embodiment of an air cap according to the disclosure in section.

FIG. 1 shows an exemplary embodiment of an air cap 1 according to the disclosure, having two horns 3 into each of which one horn air infeed duct 5, each having a horn infeed duct central axis 6 is incorporated. FIG. 1 does not show the actual size ratios of an air cap according to the disclosure but is to be understood to be only a schematic illustration. The air cap 1 has a central opening 7 having a central axis 9 which is delimited by a mouth 11 having a conical external face. The horn air infeed ducts 5 opening into inner horn air ducts 15 having inner horn air openings 15*a*, and into outer horn air ducts 17 having outer horn air openings 17*a*. Those horn air ducts or horn air openings, respectively, that are disposed so as to be closer to the central opening 7 are referred to as inner horn air ducts 15 and inner horn air openings 15*a*; those horn air ducts or horn air openings, respectively, that are located so as to be more remote from the central opening 7 are referred to as outer horn air ducts 17 and outer horn air openings 17*a*. The angle $\alpha$ at which the inner horn air ducts 15 are incorporated into the horns 3 in relation to the central axis 9 of the central opening 7 differs from the angle $\beta$ at which the outer horn air ducts 17 are incorporated into the horns 3 in relation to the central axis 9 of the central opening 7. The angles $\alpha$ of the inner horn air ducts 15 each are substantially identical, as are the angles $\beta$ of the outer horn air ducts 17. The angles $\alpha$ of the inner horn air ducts 15 are smaller than the angles $\beta$ of the outer horn air ducts 17. It is only for the sake of clarity that only one angle $\alpha$ and one angle $\beta$ each are illustrated on opposite sides of the central axis 9 in FIG. 1.

In the present exemplary embodiment, the central axes 16, 18 of all four horn air ducts 15, 17 meet at a point D which lies on the central axis 9 of the central opening 7. The point C marks the spot bore height of the outer horn air ducts 17, the point B marking the spot bore height of the inner horn air ducts 15. The spot bore height of an inner horn air duct 15 is the spacing between the front end A of the central opening 7 in the air cap 7 and an axis 21 which perpendicularly intersects the central axis 9 of the central opening 7 and runs through the centre of the inner horn air opening 15*a*. The spot bore height of an outer horn air duct 17 is the spacing between the front end A of the central opening 7 in the air cap 1 and an axis 23 which perpendicularly intersects the central axis 9 of the central opening 7 and runs through the centre of the outer horn air duct 17*a*. In the present exemplary embodiment, the spot bore height of the two inner horn air ducts 15 is in each case identical, as is the spot bore height of the two outer horn air ducts 17.

The central axes 6 of the horn air infeed ducts 5 in relation to the central axis 9 are slightly inclined, that is to say that the horn air infeed ducts 5 are incorporated into the air cap 1 in a slightly oblique manner. The reason is that the horn air ducts 15, 17 are to be designed to be as long as possible so as to achieve guiding of the horn air for as long as possible, which is why the horn air infeed ducts 5 should be disposed in the air cap 1 so as to be as far out as possible, whereas at the same time the external wall of the air cap 1 in this region, by virtue of a groove 13 in the air cap 1, would become too thin if the horn air infeed ducts 5 were to be incorporated into the air cap 1 as far out as possible in parallel with the central axis 9. By way of the inclined horn air infeed ducts 5 there is an adequate wall thickness also in the region of the groove 13, with an adequate length of the horn air ducts 15, 17. The groove 13 which is preferably designed in an encircling manner serves for receiving a locking ring (not shown in FIG. 1) by means of which the air cap 1 may be secured in an annular air nozzle (likewise not shown in FIG. 1). The bearing face 19 of the air cap 1 herein bears on an internal wall of the annular air nozzle, an external wall of the annular air nozzle bearing on the locking ring in the groove 13. The external diameter of the air cap 1 in the contact region between the air cap 1 and the annular air nozzle is somewhat smaller than the internal diameter of the annular air nozzle. On account thereof, the air cap 1 is fixed in the annular air nozzle in all directions, wherein a rotation of the air cap 1 about the central axis 9 is still possible as long as the annular air nozzle has not yet been tightened on the spray gun.

Control openings 25 are disposed in the region next to the mouth 11 that delimits the central opening 7. Only two control openings 25 which are disposed on the sectional line through the air cap 1 can be seen in FIG. 1. The control openings 25 reach through the front wall of the air cap 1 up to an internal region 27. The internal region may be formed from various conical and cylindrical faces. In the assembled state of the spray gun, the paint nozzle (not shown in FIG. 1) which may be screwed into the gun body is located in the internal region 27. The front end of the paint nozzle, or a small front plug of the paint nozzle, herein is disposed in the region of the central opening 7, conjointly with the central opening 7 forming an annular gap. The paint nozzle may at least partially reach into the central opening 7; the front end may be recessed in relation to the central opening 7, may be flush with the front end A of the central opening 7, or may project beyond the front end A of the central opening 7. Air from compressed-air ducts in the gun body flows by way of an annular air distributor into the internal region 27 of the air cap 1 and into the horn air infeed ducts 5. The proportion of air that is infed to the internal region 27 of the air cap 1, and the proportion of air that flows into the horn air infeed ducts 5, may be controlled by way of a round/wide jet regulator in the spray gun; this is furthermore influenced by the size and the design of the compressed-air ducts. The atomizing air, that is to say the air that exits from the internal region 27 of the air cap 1 out of the central opening 7, or out of the annular gap described above, respectively, suctions the material to be sprayed from the paint nozzle, atomizes said material to be sprayed, and conveys the paint mist in the direction of the object to be coated. The air from the internal region 27 of the air cap 1 simultaneously flows through the control openings 25. That part of the air that is infed to the horn air infeed ducts 5 and horn air ducts 15, 17 flows out of the horn air openings 15*a*, 17*a* in the direction of the spray jet, acts laterally on the latter, and forms the actual conical jet into an elliptic wide jet. Prior thereto, the so-called horn air that flows out of the horn air openings 15*a*, 17*a* is hit by the so-called control air that flows out of the control openings 25, is spread, that is to say widened, is damped and deflected. The control air furthermore contributes towards atomizing the medium to be sprayed, and conveys the paint mist away from the air cap 1, in particular from the region 29 that is adjacent to the mouth 11, thus reducing contamination of this region.

As can be seen in FIG. 1, the region 29 directly next to the mouth 11 that delimits the central opening 7 is inclined. On account thereof, the front end of the mouth 11 may be offset further forward from the adjacent region 29, so as to further reduce any contamination of the region 29, without extending the air cap 1 in length towards the front. Furthermore, an inflow of ambient air towards the outflow region of the atomizing air is facilitated on account of which undesirable turbulences in the region of the spray jet are prevented, as has already been mentioned here above.

Figure 2:
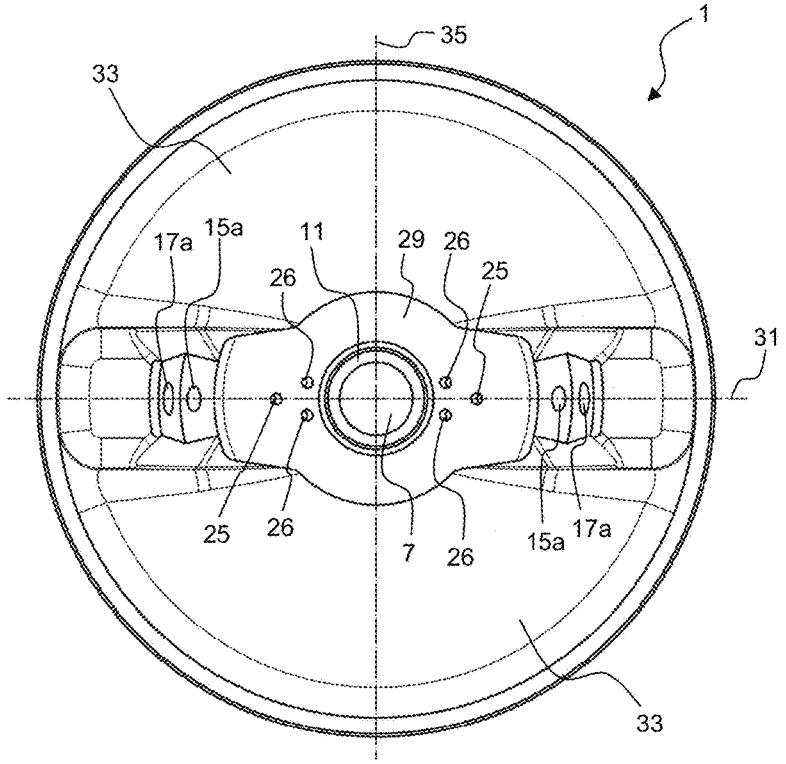
FIG. 2 shows a plan view of an exemplary embodiment of an air cap according to the disclosure.

FIG. 2 shows a plan view onto the exemplary embodiment of an air cap 1 according to the disclosure, as shown in the section in FIG. 1. FIG. 1 shows the exemplary embodiment sectioned along the symmetry axis 31 as illustrated in FIG. 2. It can be seen in FIG. 2 that the air cap 1 has in each case three control openings 25, 26 which are disposed on two mutually opposite sides of the central opening 7. In each case three control openings 25, 26 are disposed in the form of a triangle, wherein a tip of the triangle is aligned in the direction of the horn air openings 15*a*, 17*a*. This means that in each case one of the control openings, presently the control openings 25, are in line with the horn air openings 15*a*, 17*a*, and an imaginary line between the two neighbouring control openings 26 is perpendicular to the symmetry axis 31. In another exemplary embodiment, described here above, in which the spot bore height of the inner horn air ducts is further depressed, in each case two control openings are disposed on two mutually opposite sides of the central opening 7 in the air cap 1. Herein, all four control openings are in line with the horn air openings, preferably on a symmetry axis, in a manner corresponding to the symmetry axis 31 of the air cap 1. The centre of the central opening 7 preferably also lies on the symmetry axis 31, and on a further symmetry axis 35 that is perpendicular to the symmetry axis 31, as is illustrated in FIG. 2.

The region 29 next to the central opening 7, or next to the mouth 11 that delimits the central opening 7, respectively, differs from that region 33 that in FIG. 2 is shown above and below the region 29. The region 33 is conically designed in such a manner that the height of the air cap 1 decreases towards the outside, so as to enable the inflow of ambient air towards the flow region of the spray jet. The region 29 is inclined in an opposite manner, that is to say that there exists a slight depression about the mouth 11 that delimits the central opening 7, the mouth 11 being offset therefrom, on account of which a contamination of the region 29 is reduced.

Figure 3:
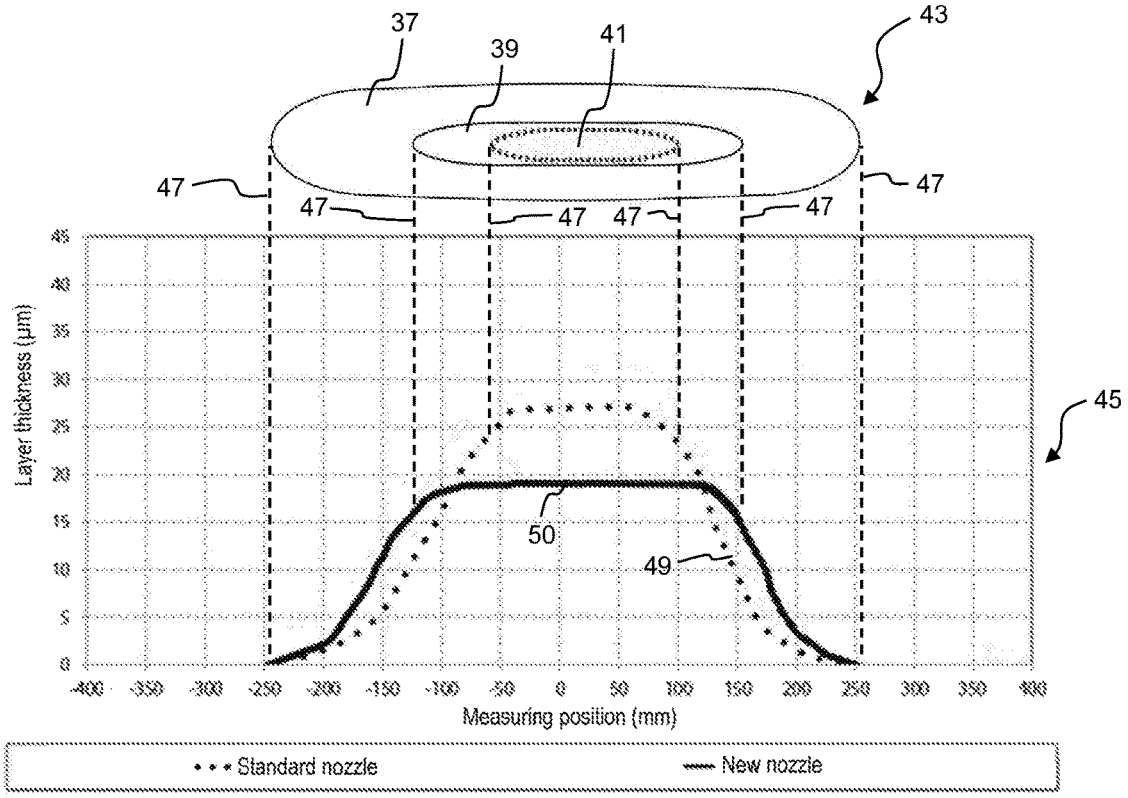
FIG. 3 schematically shows the structure of a spray pattern of a standard air cap and of a spray pattern of an exemplary embodiment of the air cap according to the disclosure, together with the profile of the layer thickness of the spray pattern across the length of the spray pattern.

FIG. 3, in the upper part, schematically shows the structure of a spray pattern 43 of a standard air cap, and of a spray pattern of an exemplary embodiment of the air cap according to the disclosure, and in the lower part, shows the profile of the layer thickness of the spray pattern across the length of the spray pattern.

The spray pattern 43 illustrated in FIG. 3 has an external region 37 and a core region 39. The spray pattern that is drawn using solid lines is the spray pattern that has been established by way of an exemplary embodiment of the air cap according to the disclosure, respectively of a spray gun which is equipped with an exemplary embodiment of the air cap according to the disclosure. The core region 41, illustrated using dotted lines in FIG. 3, shows the core region of a spray pattern that has been established by way of an air cap according to the prior art, respectively of an air gun which is equipped with an air cap according to the prior at. The external shape of the external region of the spray pattern corresponds approximately to the external shape of the external region 37 of the spray pattern that has been established by way of an exemplary embodiment of the air cap according to the disclosure, respectively of a spray gun which is equipped with an exemplary embodiment of the air cap according to the disclosure. For this reason, the external boundary of the external region of the spray pattern of an air cap according to the prior art has not been separately plotted in FIG. 3. It can be seen from the spray pattern 43 that the spray pattern of an air cap according to the disclosure in comparison to a spray pattern of an air cap according to the prior art has a longer core region, the overall length of the spray pattern however being approximately identical. As has already been mentioned here above, the boundaries of the internal and external regions are not sharply delimited but are fluid.

A diagram 45 which shows a layer thickness profile in μm over a measuring position in mm is illustrated in the lower part of FIG. 3. The auxiliary lines 47 show which measuring point in the diagram 45 is to be allocated to which point in the spray pattern 43. The diagram 47 shows measured data from a spraying experiment which have been carried out using a SATA®jet 5000 RP having a standard air cap, that is to say an air cap according to the prior art, referred to in the diagram and hereunder as a "standard nozzle", and using a SATA®jet 5000 RP having an exemplary embodiment of the air cap according to the disclosure, referred to in the diagram and hereunder as a "new nozzle". The layer thickness profile of the spray pattern that has been generated by way of the standard nozzle is illustrated as a dotted line 49 in the diagram, the layer thickness profile of the spray pattern that has been generated by way of the new nozzle appearing a solid line 50. The profile of the graphs is illustrated in a smoothed manner in FIG. 3. The spraying experiment was carried out at an entry pressure at the gun of 2 bar (29 psi), and at a spraying distance of 190 mm from the substrate, in the present case from a vertical sheet-metal panel. A painting robot moved the spray gun at a speed of 150 mm per second at a constant spraying distance in a direction perpendicular to the longitudinal axis of the wide jet generated. The wide jet was vertically aligned, the spray gun being moved from the left to the right. A bi-component solvent-based clear lacquer was sprayed. The material throughput of the paint nozzle corresponded to that of a 1.3 nozzle.

A horizontal stripe was generated in the course of the spraying experiment, wherein the layer thickness of the spray pattern was measured in the vertical direction in a central region of the stripe. The measuring position 0 mm in the diagram 45 corresponds to the position of the central axis 9 of the central opening 7 in the air cap 1 of FIG. 1, in front of the substrate to be coated, in the present case the vertical sheet-metal panel. The central axis 9 is perpendicular to the substrate. The negative range of the X-axis of the diagram 45 shows the layer thickness profile of the spray pattern along a first direction, proceeding from the measuring position 0 towards the outside, for example towards the top, the positive range showing the layer thickness profile of the spray pattern along the opposite direction, proceeding from the measuring position 0 towards the outside, for example towards the bottom. The layer thickness of the spray pattern was thus measured across a length or height, respectively, of approx. 550 mm.

It can be seen in the diagram 45 that the zero point of the layer thickness in the case of the standard nozzle as well as in the case of the new nozzle lies at the outer end of the spray pattern, at the left end in FIG. 3, at the same measuring position of approx. −275 μm. However, the layer thickness of the spray pattern that has been generated by way of the new nozzle soon increases more rapidly than is the case with the layer thickness of the spray pattern that has been generated by way of the standard air nozzle. The core region in the case of the new nozzle commences already sooner, that is to say further outside in the spray pattern, than is the case with the standard nozzle. The plateau, that is to say the region of the spray pattern having a roughly identical layer thickness, is wider in the case of the new nozzle than in the case of the standard nozzle. However, it can be seen that the plateau in the case of the new nozzle is at a lower level than is the case with the plateau of the standard nozzle. This means that the layer thickness in the core region of the new nozzle is less than in the core region of the standard nozzle. This is a consequence of the wider plateau, that is to say of the longer core region, at the same material throughput and the same application rate of efficiency. Nevertheless, coatings of a higher quality may be generated using the air cap according to the present disclosure than is possible using air caps according to the prior art.

It is finally to be pointed out that the exemplary embodiments described only describe a limited selection of potential embodiments and thus do not represent any limitation of the present disclosure.

What is claimed is:

1. An air cap for a spray gun comprising:

a central opening defined by a peripheral rim, the peripheral rim having a conical external face; and two horns arranged on opposite sides of the central opening, each of the two horns having an inner air duct disposed in proximity to the central opening and extending inwardly from the respective horn toward the central opening and an outer air duct disposed further from the central opening than the inner air duct and extending inwardly from the respective horn toward the central opening;

wherein a space between a front end of the central opening and a point B at which a line extending from an axis of one of the inner air ducts perpendicularly intersects an axis of the central opening measures between 2.4 mm and 2.6 mm and an angle between the axis of the one of the inner air ducts and the axis of the central opening measures between 57° and 60°.

2. The air cap according to claim 1, wherein a space between the front end of the central opening and a point C at which a line extending from an axis of one of the outer air ducts perpendicularly intersects the axis of the central opening measures between 6.0 mm and 6.6 mm.

3. The air cap according to claim 2, wherein the space between the front end of the central opening and the point C measures between 6.2 mm and 6.4 mm.

4. The air cap according to claim 1, wherein an angle between an axis of one of the outer air ducts and the axis of the central opening measures between 78° and 82°.

5. The air cap according to claim 4, wherein the angle between the axis of the one of the outer air ducts and the axis of the central opening measures between 79° and 80.5°.

6. The air cap according to claim 5, wherein the angle between the axis of the one of the outer air ducts and the axis of the central opening is a spot bore angle of the one of the outer air ducts and the angle between the axis of the one of the inner air ducts and the axis of the central opening is a spot bore angle of the inner air duct.

7. The air cap according to claim 6, wherein a ratio of the spot bore angle of the one of the outer air ducts to the spot bore angle of the one of the inner air ducts is between 1.2 and 1.6.

8. The air cap according to claim 1, wherein a space between one of the inner air ducts and one of the outer air ducts along the axis of the central opening measures between 3.3 mm and 5.8 mm.

9. The air cap according to claim 8, wherein the space between the one of the inner air ducts and the one of the outer air ducts along the axis of the central opening measures between 3.4 mm and 4.2 mm.

10. The air cap according to claim 1, wherein an internal diameter of at least one of the two inner air ducts measures between 1.1 mm and 1.3 mm.

11. The air cap according to claim 10, wherein the internal diameter of the at least one of the two inner air ducts is 1.2 mm.

12. The air cap according to claim 1, wherein an internal diameter of at least one of the two outer air ducts measures between 1.4 mm and 1.6 mm.

13. The air cap according to claim 12, wherein the internal diameter of the at least one of the two outer air ducts is 1.5 mm.

14. The air cap according to claim 1, wherein the space between the front end of the central opening and the point B at which the line extending from the axis of the one of the inner air ducts perpendicularly intersects the axis of the central opening is a spot bore height of the one of the inner air ducts and an internal diameter of the one of the inner air ducts measures between 1.1 mm and 1.3 mm.

15. The air cap according to claim 14, wherein a ratio of the spot bore height of the one of the inner air ducts to the internal diameter of the one of the inner air ducts is between 1.7 and 2.4.

16. The air cap according to claim 2, wherein the space between the front end of the central opening and the point C at which the line extending from the axis of the one of the outer air ducts perpendicularly intersects the axis of the central opening is a spot bore height of the one of the outer air ducts and an internal diameter of the one of the outer air ducts measures between 1.4 mm and 1.6 mm.

17. The air cap according to claim 16, wherein a ratio of the spot bore height of the one of the outer air ducts to the internal diameter of the one of the outer air ducts is between 3.8 and 4.5.

18. The air cap according to claim 1, wherein a front face of the air cap includes six control openings disposed in groups of three in a shape of a triangle on opposite sides of the central opening, a tip of each triangle aligned in a direction of the inner or outer air ducts.

19. The air cap according to claim 18, wherein the control openings have an angle of between 8° and 12° in relation to the axis of the central opening.

20. The air cap according to claim 1, wherein a front face of the air cap includes four control openings disposed in groups of two on opposite sides of the central opening, the groups aligned in a direction of the inner or outer air ducts.

21. The air cap according to claim 1, wherein an internal diameter of the central opening measures between 3.5 mm and 3.7 mm.

22. The air cap according to claim 1, wherein the conical external face of the peripheral rim of the central opening has an angle of between 25° and 35° in relation to the axis of the central opening.

23. The air cap according to claim 1, wherein an axis of at least one of the two inner air ducts and an axis of at least one of the two outer air ducts intersect at a point along the axis of the central opening.

24. The air cap according to claim 23, wherein a space between the front end of the central opening and the point of intersection of the axis of the at least one inner air duct and the axis of the at least one outer air duct measures between 7.5 mm and 8.5 mm.

25. An air cap for a spray gun comprising:

a central opening defined by a peripheral rim, the peripheral rim having a conical external face; and two horns arranged on opposite sides of the central opening, each of the two horns having an inner air duct disposed in proximity to the central opening and extending inwardly from the respective horn toward the central opening and an outer air duct disposed further from the central opening than the inner air duct and extending inwardly from the respective horn toward the central opening;

wherein a space between a front end of the central opening and a point B at which a line extending from an axis of one of the inner air ducts perpendicularly intersects an axis of the central opening is a spot bore height of the one of the inner air ducts and measures between 2.4 mm and 2.6 mm and an angle between the axis of the one of the inner air ducts and the axis of the central opening measures between 57° and 60°; and wherein a space between the front end of the central opening and a point C at which a line extending from an axis of one of the outer air ducts perpendicularly intersects the axis of the central opening is a spot bore height of the one of the outer air ducts and measures between 6.2 mm and 6.4 mm and an angle between the axis of the one of the outer air ducts and the axis of the central opening measures between 78° and 82°.

26. The air cap according to claim 25, wherein a ratio of the spot bore height of the one of the outer air ducts to the spot bore height of the one of the inner air ducts is between 2.0 and 3.0.

27. A nozzle assembly for a spray gun comprising the air cap according to claim 1.

28. A spray gun comprising the nozzle assembly according to claim 27.

29. A spray gun comprising the air cap according to claim 1.

30. A spray gun comprising the air cap according to claim 25.

* * * * *